US010048631B2

(12) United States Patent
Shibuya et al.

(10) Patent No.: US 10,048,631 B2
(45) Date of Patent: Aug. 14, 2018

(54) IMAGE FORMING APPARATUS AND LIFETIME PREDICTION METHOD

(71) Applicant: Konica Minolta, Inc., Chiyoda-ku, Tokyo (JP)

(72) Inventors: Satoru Shibuya, Chiryu (JP); Hideo Yamaki, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/796,945

(22) Filed: Oct. 30, 2017

(65) Prior Publication Data

US 2018/0120748 A1 May 3, 2018

(30) Foreign Application Priority Data

Oct. 31, 2016 (JP) ..... 2016-213102

(51) Int. Cl.
*G03G 15/16* (2006.01)
*G03G 15/00* (2006.01)

(52) U.S. Cl.
CPC ..... *G03G 15/553* (2013.01); *G03G 15/16* (2013.01)

(58) Field of Classification Search
CPC ..... G03G 15/16; G03G 15/553
See application file for complete search history.

(56) References Cited

U.S. PATENT DOCUMENTS 7,016,618 B2 * 3/2006 Jeong ..... G03G 15/553 399/24
7,676,164 B2 * 3/2010 Shiori ..... G03G 15/553 399/24
8,798,487 B2 * 8/2014 Asano ..... G03G 15/5037 399/26

FOREIGN PATENT DOCUMENTS

JP 2004-184601 A 7/2004
JP 2006-154006 A 6/2006

* cited by examiner

*Primary Examiner* — Gregory H Curran
(74) *Attorney, Agent, or Firm* — Buchanan Ingersoll & Rooney PC

(57) ABSTRACT

An image forming apparatus includes an image carrier, a transfer member, a measurement instrument, and a controller. The controller is configured to predict a lifetime of the transfer member based on first and second electrical states. The first electrical state is an electrical state of the transfer member when a first image carrier is attached as the image carrier. The second electrical state is an electrical state of the transfer member when a second image carrier different from the first image carrier is attached as the image carrier after formation of an image with the use of the first image carrier.

14 Claims, 17 Drawing Sheets

IMAGE FORMING APPARATUS AND LIFETIME PREDICTION METHOD

Japanese Patent Application No. 2016-213102 filed on Oct. 31, 2016 including description, claims, drawings, and abstract the entire disclosure is incorporated herein by reference in its entirety.

BACKGROUND

Technological Field

The present disclosure relates to an image forming apparatus configured to predict a lifetime of a transfer member such as a primary transfer roller opposed to an image carrier with a transfer target such as paper or an intermediate transfer body being interposed.

Description of the Related Art

Products have recently been demanded to be environment friendly. By way of example, a longer lifetime of a component constituting a product and accurate determination of timing of replacement of such a component have been demanded. Such a technique has strongly been demanded also for an image forming apparatus such as a multi-functional peripheral (MFP). For example, Japanese Laid-Open Patent Publication No. 2004-184601 discloses a method of sensing timing of replacement of a transfer roller in an image recording apparatus. The image recording apparatus compares an actually measured resistance value of a transfer roller found from a transfer current value and a transfer voltage value with a reference resistance value and determines that end of a life of the transfer roller has come when the actually measured resistance value is greater than the reference resistance value. The technique described in Japanese Laid-Open Patent Publication No. 2004-184601, however, may not be able to accurately calculate a lifetime of the transfer roller under the influence by progressing use of a photoconductor.

Prediction of timing of replacement of a component in various products including an image forming apparatus has also been demanded. For example, Japanese Laid-Open Patent Publication No. 2006-154006 discloses an image forming apparatus which predicts a lifetime of an image carrier such as a photoconductor drum. In the image forming apparatus, a current is fed to a transfer member at a first current value and a second current value. The image forming apparatus conducts linear regression analysis with the first current value and a corresponding first voltage value and the second current value and a corresponding second voltage value to thereby find a system resistance R and an offset potential A, and predicts a thickness of a photosensitive layer of a photoconductor drum based on offset potential A. The image forming apparatus determines a lifetime of the photoconductor drum based on the predicted thickness.

Though the technique disclosed in Japanese Laid-Open Patent Publication No. 2006-154006 is advantageous in prediction of timing of replacement of a component, it may complicate a configuration of the image forming apparatus because it is necessary to set a plurality of values for currents to be fed to the transfer member in the image forming apparatus.

SUMMARY

To achieve at least one of the above-mentioned objects, according to an aspect of the present disclosure, an image forming apparatus reflecting one aspect of the present disclosure includes an image carrier, a transfer member, a measurement instrument, and a controller. The image carrier is set in the image forming apparatus as being replaceable. The transfer member is arranged as being opposed to the image carrier with a transfer target being interposed. The transfer member is configured to transfer a toner image formed on the image carrier to the transfer target. The measurement instrument is configured to measure at least one of a voltage value and a current value of the transfer member as an electrical state of the transfer member while the transfer member is brought in pressure contact with the image carrier with the transfer target being interposed. The controller is configured to predict a lifetime of the transfer member based on a first electrical state and a second electrical state. The first electrical state is an electrical state of the transfer member when a first image carrier is attached as the image carrier. The second electrical state is an electrical state of the transfer member when a second image carrier different from the first image carrier is attached as the image carrier after formation of an image with the use of the first image carrier.

To achieve at least one of the above-mentioned objects, according to another aspect of the present disclosure, a method of predicting a lifetime of a transfer member which is implemented by a computer of an image forming apparatus is provided. The image forming apparatus includes an image carrier set as being replaceable and a transfer member which is arranged as being opposed to the image carrier with a transfer target being interposed and transfers a toner image formed on the image carrier to the transfer target. The method includes obtaining a first electrical state including at least one of a voltage value and a current value of the transfer member when a first image carrier is attached as the image carrier, obtaining a second electrical state including at least one of a voltage value and a current value of the transfer member when a second image carrier different from the first image carrier is attached as the image carrier after formation of an image with the use of the first image carrier, and predicting a lifetime of the transfer member based on the first electrical state and the second electrical state.

BRIEF DESCRIPTION OF THE DRAWINGS

The advantages and features provided by one or more embodiments of the invention will become more fully understood from the detailed description given hereinbelow and the appended drawings which are given by way of illustration only and thus are not intended as a definition of the limits of the present invention.

DETAILED DESCRIPTION OF EMBODIMENTS

Figure 1:
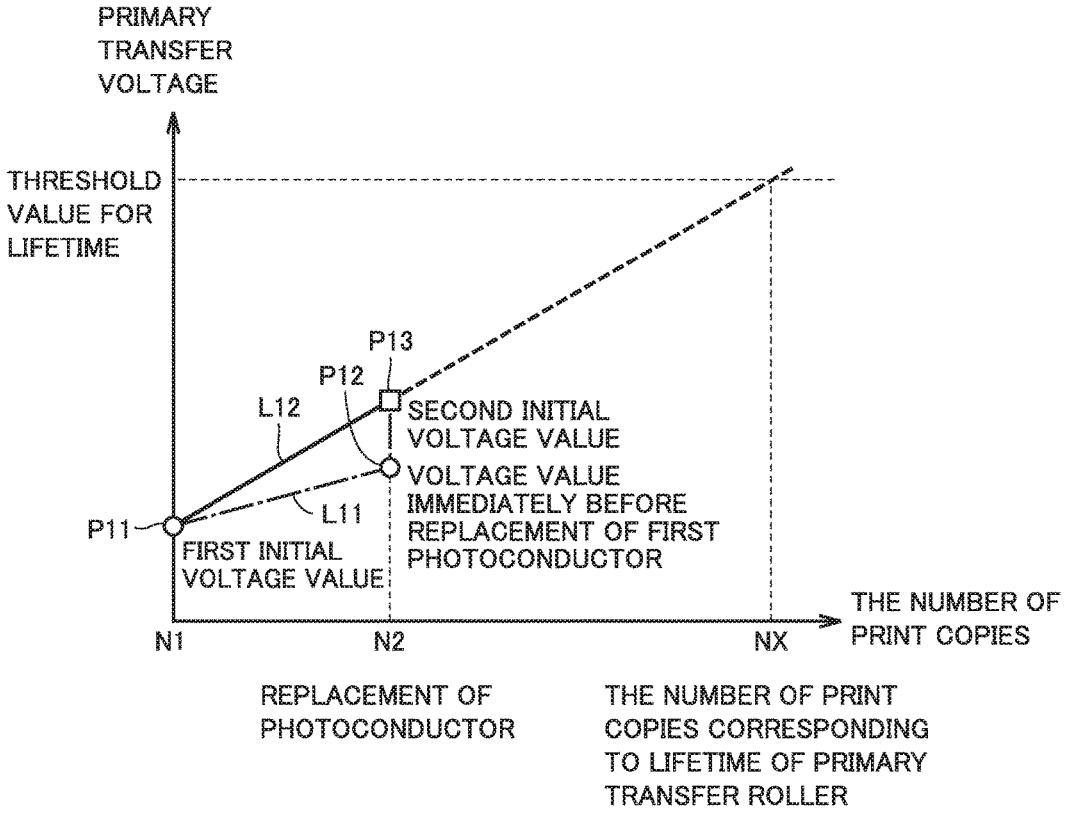
FIG. 1 is a diagram for schematically illustrating one example of a manner of prediction of a lifetime of a primary transfer roller in an image forming apparatus in the present disclosure.

Hereinafter, one or more embodiments of the present invention will be described with reference to the drawings. However, the scope of the invention is not limited to the disclosed embodiments.

An embodiment of an information processing apparatus will be described below with reference to the drawings. The same elements and components in the description below have the same reference characters allotted. Their labels and functions are also the same. Therefore, description thereof will not be repeated.

Introduction

An electrophotographic image forming apparatus may include a photoconductor drum (which will hereinafter also simply be referred to as a "photoconductor") as an image carrier which carries a toner image, a primary transfer roller as a transfer member opposed to the image carrier with a transfer target such as an intermediate transfer body being interposed, and a conductive member such as a secondary transfer roller. The primary transfer roller abuts on a photoconductor roller with an intermediate transfer belt being interposed. In the image forming apparatus, as a current is supplied to the primary transfer roller, a primary transfer current flows through the primary transfer roller, the intermediate transfer belt, and the photoconductor. Transfer electric field is thus formed between the photoconductor and the intermediate transfer belt and a toner image on the photoconductor is transferred to the intermediate transfer belt as a transfer target.

When a thickness of a photosensitive layer (which will hereinafter simply be referred to as a "thickness") decreases in the photoconductor, an amount of charges provided from the primary transfer roller to the photoconductor increases even when the same voltage is applied to the primary transfer roller, which is shown in an expression (1) as follows:

$$Q=CV \tag{1}$$

where Q represents an amount of charges (close to an "amount of transfer current") provided from the primary transfer roller to the photoconductor, C represents a capacitance of the photoconductor, and V represents a voltage in a transfer portion (a potential difference across the primary transfer roller and the photoconductor).

C in the expression (1) is calculated in an expression (2) as follows:

$$C=\varepsilon S/d \tag{2}$$

where ε represents a dielectric constant of the photoconductor, S represents an area of contact in transfer, and d represents a thickness of the photoconductor.

An expression (3) as follows is derived from the expressions (1) and (2).

$$Q=\varepsilon SV/d \tag{3}$$

It can be understood from the expression (3) that a value for Q increases with decrease in value for d due to progressing use of the photoconductor. Thus, in the transfer portion, with progressing use of the photoconductor, a current is more likely to flow from the primary transfer roller to the photoconductor. Therefore, the technique for calculating a lifetime of the primary transfer roller by finding a resistance of the primary transfer roller from a voltage of the transfer portion as described in Japanese Laid-Open Patent Publication No. 2004-184601 may not be able to accurately calculate a lifetime of the primary transfer roller, because increase in resistance of the primary transfer roller in accordance with use of the primary transfer roller may be canceled by increase in value for Q due to decrease in thickness of the photoconductor.

The image forming apparatus according to the present disclosure predicts a lifetime of the primary transfer roller by setting a photoconductor serving as an image carrier as being replaceable in an apparatus main body and making use of an electrical state of the primary transfer roller at the time of replacement of the photoconductor. A manner of prediction will be described in further detail with reference to FIG. 1. FIG. 1 is a diagram for schematically illustrating one example of the manner of prediction of a lifetime of the primary transfer roller in the image forming apparatus in the present disclosure.

In the graph in FIG. 1, the ordinate represents a primary transfer voltage (a voltage, value of the primary transfer roller when a current for transfer is supplied to the primary transfer roller). The abscissa represents the number of print copies in the image forming apparatus (an amount of recording media to which a toiler image has been transferred).

In the graph in FIG. 1, a point P11 is a plot at the time when a first photoconductor is attached as an image carrier in the image forming apparatus. Point P11 is, for example, a plot immediately after attachment of the first photoconductor or when the number of print copies after attachment is small. Point P11 shows a state immediately after attachment of the first photoconductor or a state close thereto.

A voltage value of the primary transfer roller in the state immediately after attachment of the photoconductor or the state close thereto is herein called an "initial voltage value."

An initial voltage value of an Nth photoconductor in the image forming apparatus is called an "Nth initial voltage value." For example, an initial voltage value of a first photoconductor is called a "first initial voltage value" and an initial voltage value of a second photoconductor is called a "second initial voltage value."

The first initial voltage value represents one example of the "first electrical state." The second initial voltage value represents one example of the "second electrical state." The first electrical state and the second electrical state do not necessarily have to be states of a plurality of photoconductors successively attached to the image forming apparatus. For example, the first electrical state may be represented by the first initial voltage value and the second electrical state may be represented by a third initial voltage value.

A point P12 is a plot after the first photoconductor is attached and an image has been formed a prescribed number of times. More specifically, it is a plot in a state immediately before replacement of the first photoconductor with a second photoconductor different from the first photoconductor. Point P12 is higher in primary transfer voltage than point P11.

A point P13 is a plot at the time when the second photoconductor is attached as the image carrier. The primary transfer voltage specified by point P13 corresponds to the second initial voltage value. Point P13 is higher in primary transfer voltage than point P12. Such increase is mainly attributed to increase in thickness resulting from replacement of the photoconductor. A difference in value for the primary transfer voltage between point P13 and point P12 mainly indicates decrease in thickness (increase in thickness owing to replacement) owing to use of the photoconductor.

In the present embodiment, the image forming apparatus predicts a lifetime of the primary transfer roller by using a plurality of values for the primary transfer voltage representing the time of start of use of the photoconductor (that is, a "value for the primary transfer voltage at point P11" and a "value for the primary transfer voltage at point P13"). Thus, such a situation that increase in value for a resistance of the primary transfer roller due to deterioration of the primary transfer roller is disguised by decrease in thickness of the photoconductor can be avoided. Therefore, timing (lifetime) at which a value for the primary transfer voltage attains to a value corresponding to a state requiring the primary transfer roller can more accurately be predicted.

In the example in FIG. 1, linear regression analysis of the primary transfer voltage and the number of print copies is conducted by using point P11 and point P13. A linear expression (a line L12) of a primary transfer value and the number of print copies is generated. The image forming apparatus specifies the number of print copies corresponding to a value for the primary transfer voltage (a "threshold value for lifetime" in FIG. 1) corresponding to the primary transfer roller of which end of life has come, in accordance with line L12. A result of prediction of the lifetime is not limited to the number of print copies.

First Embodiment (Schematic Configuration)

Figure 2:
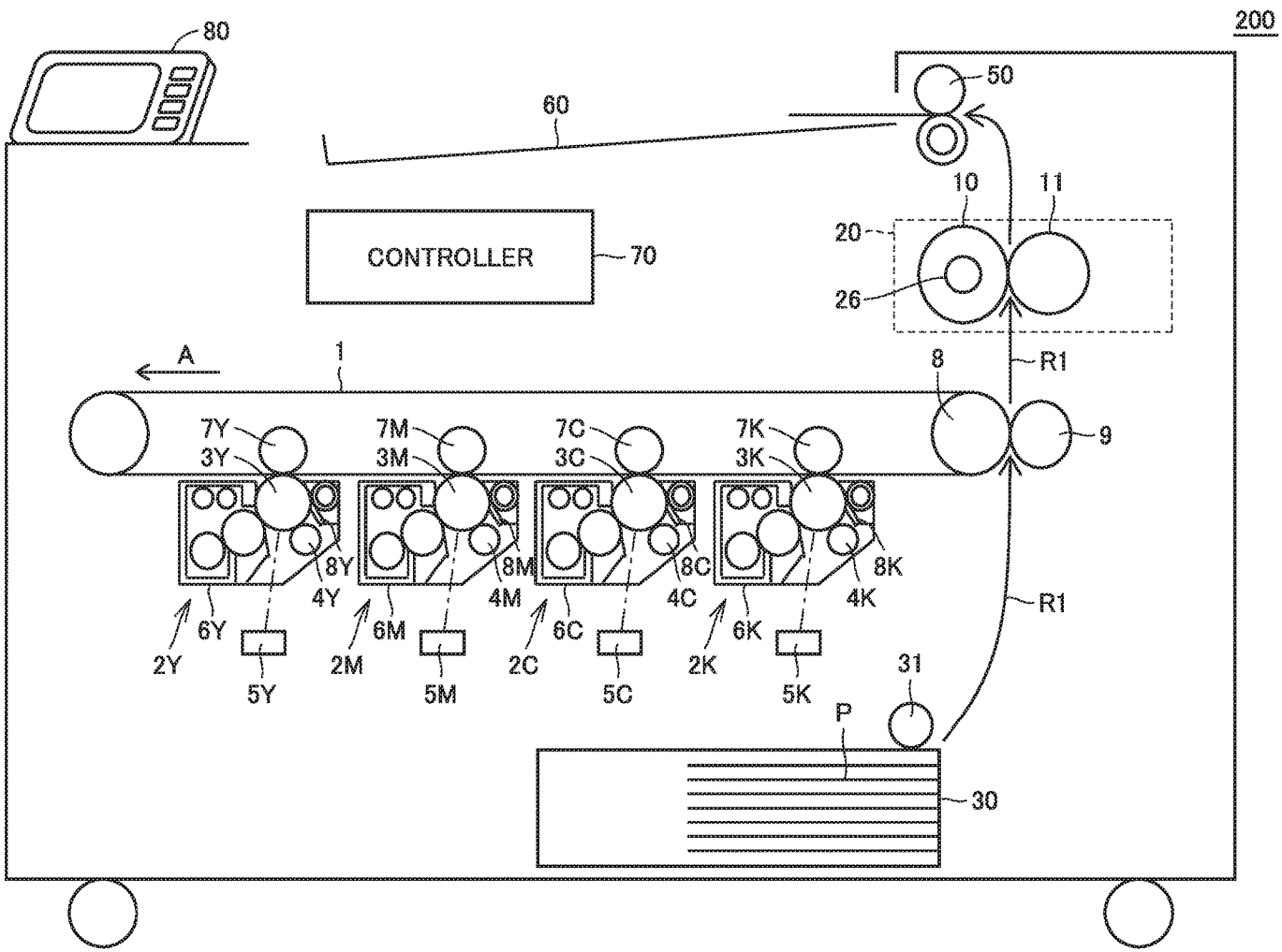
FIG. 2 is a diagram illustrating a configuration example of an image forming apparatus according to one embodiment.

FIG. 2 is a diagram illustrating a configuration example of an image forming apparatus 200 according to one embodiment. In one embodiment, image forming apparatus 200 is an electrophotographic image forming apparatus such as a laser printer or a light emitting diode (LED) printer. As shown in FIG. 2, image forming apparatus 200 includes an intermediate transfer roller 1 as a belt member substantially in a central portion of the inside. Four imaging units 2Y, 2M, 2C, and 2K corresponding to colors of yellow (Y), magenta (M), cyan (C), and black (K), respectively, are arranged as being aligned along intermediate transfer roller 1 under a lower horizontal portion of intermediate transfer roller 1. Imaging units 2Y, 2M, 2C, and 2K have photoconductors 3Y, 3M, 3C, and 3K configured to be able to carry toner images, respectively.

Charging rollers 4Y, 4M, 4C, and 4K for charging corresponding photoconductors, print head portions 5Y, 5M, 5C, and 5K, development rollers 6Y, 6M, 6C, and 6K, and primary transfer rollers 7Y, 7M, 7C, and 7K opposed to photoconductors 3Y, 3M, 3C, and 3K with intermediate transfer roller 1 being interposed are arranged sequentially around photoconductors 3Y, 3M, 3C, and 3K representing the image carriers along a direction of rotation thereof, respectively.

A secondary transfer roller 9 is brought in pressure contact with a portion of intermediate transfer roller 1 supported by an intermediate transfer belt drive roller 8 and secondary transfer is performed in that region. A fixing and heating portion 20 including a fixing, roller 10 and a pressurization roller 11 is arranged at a downstream position in a transportation path R1 subsequently to a secondary transfer region.

A paper feed cassette 30 is removably arranged in a lower portion of image forming apparatus 200. Paper P loaded and accommodated in paper feed cassette 30 is sent one by one from a sheet of paper located at the top to transportation path R1 as a paper feed roller 31 rotates. Paper P represents one example of a recording medium.

An operation panel 80 is arranged in an upper portion of image forming apparatus 200. Operation panel 80 is constituted of a screen in which a touch panel and a display are layered on each other and a physical button by way of example.

In one aspect, intermediate transfer roller 1, charging rollers 4Y, 4M, 4C, and 4K, primary transfer rollers 7Y, 7M, 7C, and 7K, and secondary transfer roller 9 may function as an ion conductive member. By way of example, such a conductive member may contain ion conductive rubber in which hydrin rubber, acrylonitrile butadiene rubber, or epichlorohydrin rubber is blended. Each conductive member may contain an appropriate ion conductive material depending on a required characteristic.

Though image forming, apparatus 200 adopts a tandem intermediate transfer scheme in the example above, limitation thereto is not intended. Specifically, the image forming apparatus should only contain an ion conductive member, and an image forming apparatus adopting a cycle scheme or an image forming apparatus adopting a direct transfer scheme in which toner is directly transferred from a development apparatus to a printing medium may be applicable.

(Schematic Operation)

A schematic operation of image forming apparatus 200 will now be described. When an image signal is input to a controller 70 of image forming apparatus 200 from an external apparatus (such as a personal computer), controller 70 generates digital image signals obtained by conversion of this image signal into signals of colors of yellow, cyan, magenta, and black and has print head portions 5Y, 5M, 5C, and 5K of respective imaging units 2Y, 2M, 2C, and 2K emit light based on the input digital signals for exposure.

Electrostatic latent images formed on respective photoconductors 3Y, 3M, 3C, and 3K are thus developed by respective developing devices 6Y, 6M, 6C, and 6K to become toner images of respective colors. The toner images of these colors are primarily transferred onto intermediate transfer roller 1 which moves in a direction shown with an arrow A in FIG. 2 as being successively superimposed on one another as a result of functions of primary transfer rollers 7Y, 7M, 7C, and 7K.

The toner image thus formed on intermediate transfer roller 1 is secondarily collectively transferred onto paper P as a result of a function of secondary transfer roller 9.

The toner image secondarily transferred to paper P reaches fixing and heating portion 20. The toner image is fixed to paper P as a result of functions of heated fixing roller 10 and pressurization roller 11. Paper P to which the toner image has been fixed is ejected to a paper ejection tray 60 through a paper ejection roller 50.

(Partial Hardware Configuration)

Figure 3:
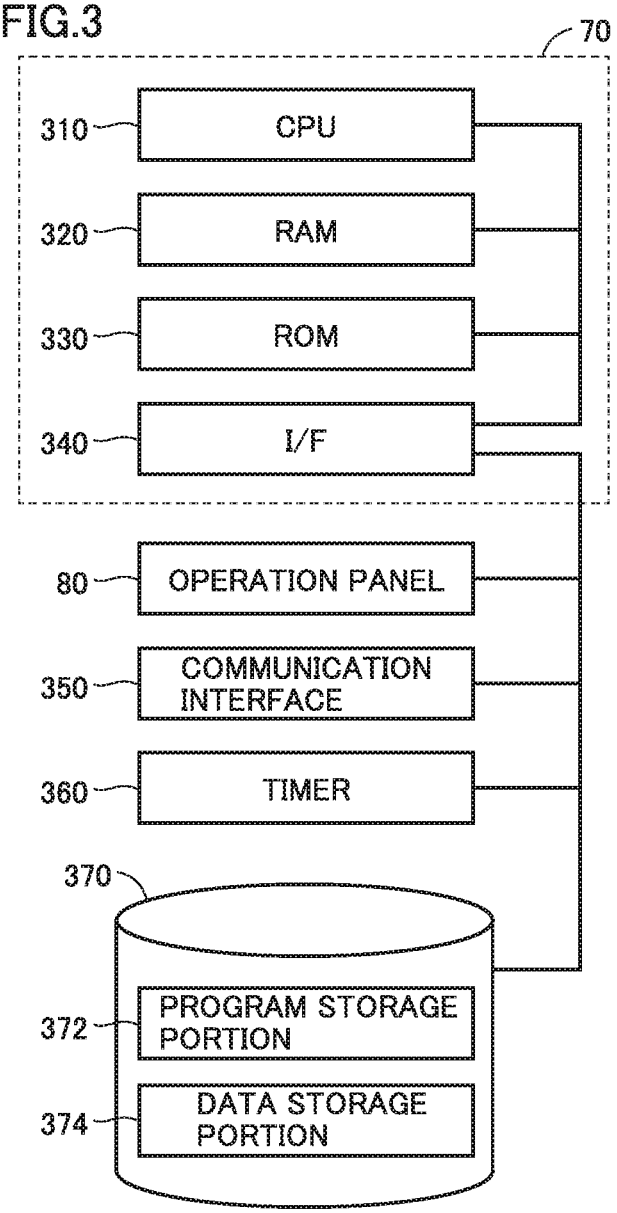
FIG. 3 is a diagram showing one example of a partial hardware configuration of the image forming apparatus in FIG. 2.

FIG. 3 is a diagram showing one example of a partial hardware configuration of image forming apparatus 200 in FIG. 2.

As shown in FIG. 3, controller 70 includes, as its main control elements, a central processing unit (CPU) 310, a random access memory (RAM) 320, a read only memory (ROM) 330, and an interface (I/F) 340.

CPU 310 operates as a computer of image forming apparatus 200 and controls an operation of image forming apparatus 200 by reading and executing a control program stored in ROM 330 or a storage device 370 which will be described later.

RAM 320 is typically implemented by a dynamic random access memory (DRAM). RAM 320 may temporarily store data necessary for CPU 310 to operate a program or image data. RAM 320 may function as what is called a working memory.

ROM 330 is typically implemented by a flash memory and may store a program executed by CPU 310 or various types of setting information relating to an operation of image forming apparatus 200.

CPU 310 is electrically connected to operation panel 80, a communication interface 350, a timer 360, and storage device 370 with interface 340 being interposed and exchanges signals with various apparatuses.

Communication interface 350 is implemented by a wireless local area network (LAN) card by way of example. Image forming apparatus 200 is configured to be able to communicate with an external apparatus (a personal computer, a smartphone, or a tablet) connected to a LAN or a wide area network (WAN) through communication interface 350.

Timer 360 counts time. By way of example, timer 360 is implemented by a crystal oscillator.

Storage device 370 is typically implemented by a hard disk drive. Storage device 370 includes a program storage portion 372 and a data storage portion 374. Program storage portion 372 may store a program to be executed by CPU 310. Data storage portion 374 may store data used for control of image forming apparatus 200 such as a threshold value for a lifetime (FIG. 1).

Image forming apparatus 200 includes an element driven in an operation for forming an image. Controller 70 is connected to such an element and may control an operation of the element. The element includes, for example, various rollers constituting imaging units 2Y, 2M, 2C, and 2K (FIG. 2).

(Configuration in the Vicinity of Primary Transfer Roller)

Figure 4:
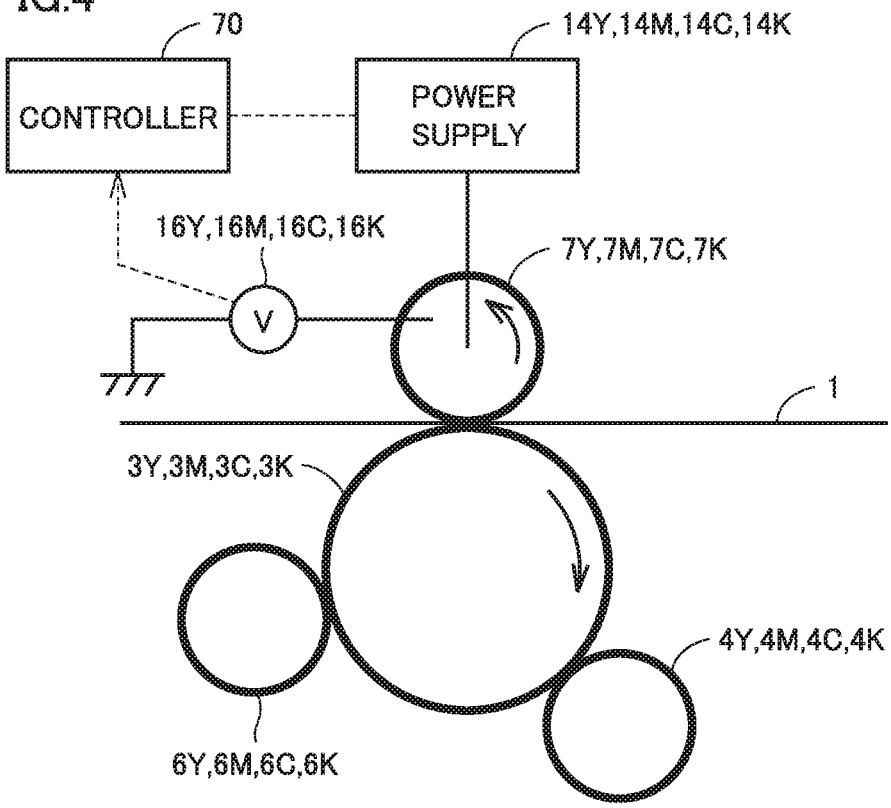
FIG. 4 is a diagram showing a configuration example in the vicinity of a primary transfer roller in the image forming apparatus in FIG. 2.

FIG. 4 is a diagram showing a configuration example in the vicinity of primary transfer rollers 7Y, 7M, 7C, and 7K in image forming apparatus 200 in FIG. 2.

As shown in FIG. 4, power supplies 14Y, 14M, 14C, and 14K and voltmeters 16Y, 16M, 16C, and 16K are electrically connected to primary transfer rollers 7Y, 7M, 7C, and 7K, respectively. Power supplies 14Y, 14M, 14C, and 14K and voltmeters 16Y, 16M, 16C, and 16K are electrically connected to controller 70.

Controller 70 controls power supplies 14Y, 14M, 14C, and 14K to have them supply constant currents to respective primary transfer rollers 7Y, 7M, 7C, and 7K and obtains measurement values from voltmeters 16Y, 16M, 16C, and 16K at that time. Controller 70 can thus indirectly obtain resistance values of primary transfer rollers 7Y, 7M, 7C, and 7K.

In another aspect, image forming apparatus 200 may include an ammeter for measuring a value for a current which flows through each of primary transfer rollers 7Y, 7M, 7C, and 7K instead of or in addition to voltmeters 16Y, 16M, 16C, and 16K.

In image forming apparatus 200, primary transfer rollers 7Y, 7M, 7C, and 7K represent one example of the transfer member. Voltmeters 16Y, 16M, 16C, and 16K represent one example of a measurement instrument configured to measure at least one of a voltage value and a current value of the transfer member. The ammeter represents another example of the measurement instrument configured to measure at least one of a voltage value and a current value of the transfer member.

In yet another aspect, power supplies 14Y, 14M, 14C, and 14K may be implemented as one common power supply. These power supplies may be power supplies the same as or different from a power supply which applies a charging bias for charging a photoconductor.

Image forming apparatus 200 may further include a feature for obtaining electrical characteristics of a charging roller implemented by an ion conductive member. Image forming apparatus 200 may include a feature for obtaining electrical characteristics of intermediate transfer roller 1 and secondary transfer roller 9.

(Manner of Prediction of Lifetime of Primary Transfer Roller)

Figure 5:
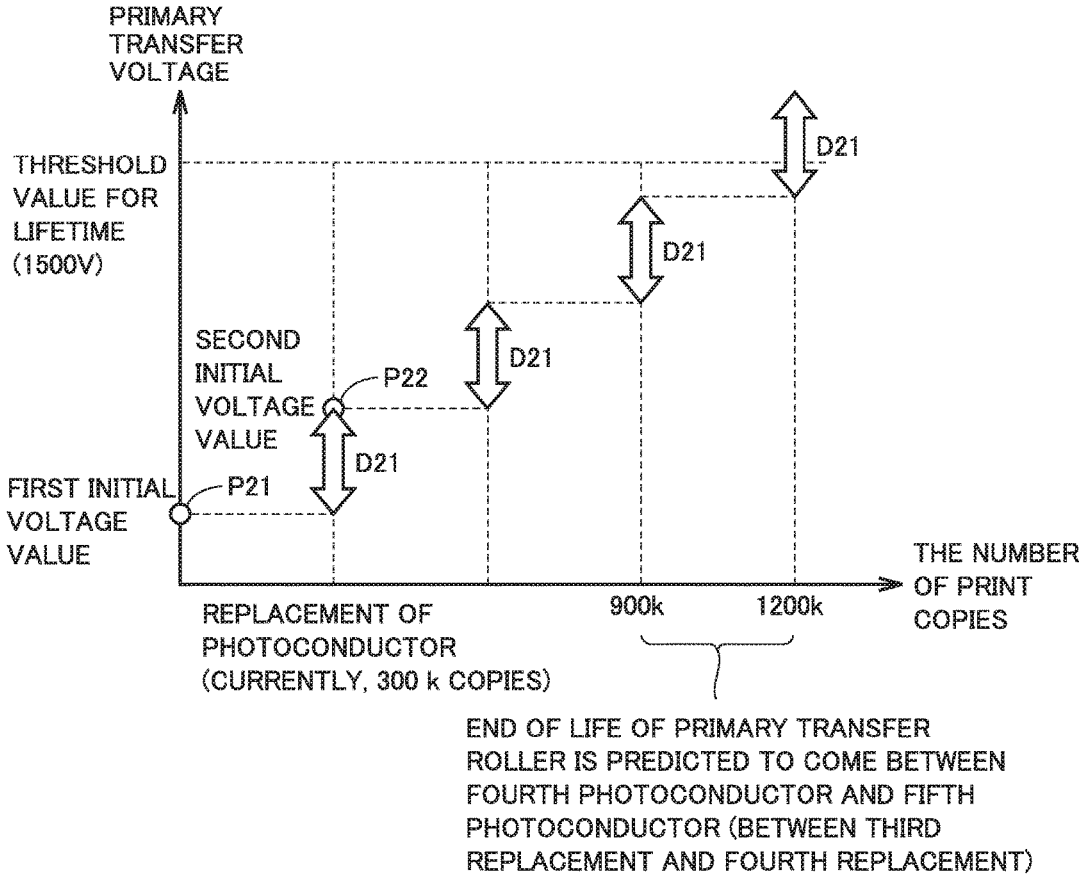
FIG. 5 is a diagram for illustrating one example of a manner of prediction of a lifetime of the primary transfer roller in the image forming apparatus.

FIG. 5 is a diagram for illustrating one example of a manner of prediction of a lifetime of (each of) primary transfer rollers 7Y, 7M, 7C, and 7K in image forming apparatus 200.

In the graph in FIG. 5, the ordinate represents a primary transfer voltage. The abscissa represents the number of print copies in image forming apparatus 200. A point P21 is a plot corresponding to a first initial voltage value. A point P22 is a plot corresponding to a second initial voltage value.

Image forming apparatus 200 includes an element which detects the number of print copies (the number of sheets of paper P to which an image has been transferred). CPU 310 may obtain the number of print copies from the element.

In image forming apparatus 200, CPU 310 (FIG. 3) obtains point P21 when a first photoconductor is attached and obtains point P22 when a second photoconductor is attached. CPU 310 may have a feature which detects attachment of a new photoconductor. Each of photoconductors 3Y, 3M, 3C, and 3K includes, for example, a circuit which receives supply of a current when it is attached to image forming apparatus 200. The circuit includes a fuse. The fuse is configured to be blown when a current is supplied to the circuit at the time of attachment to image forming apparatus 200. CPU 310 detects attachment of a new photoconductor by detecting feed of a current to the circuit and subsequent stop of feed of the current.

CPU 310 may detect attachment of a new photoconductor in response a specific operation onto operation panel 80. Operation panel 80 represents one embodiment of a detector. Naturally, image forming apparatus 200 may be configured to detect attachment of a photoconductor with another detector (for example, a physical switch which is pressed by a photoconductor arranged at an appropriate position and transmits a signal indicating whether or not the switch has been pressed to CPU 310).

Image forming apparatus 200 includes a paper counter which counts the number of sheets of paper on which an image has been formed. CPU 310 obtains the number of print copies by referring to a count value of the counter.

CPU 310 obtains a difference in value for a primary transfer voltage between the time of start of use of the first photoconductor and the time of start of use of the second photoconductor for each of photoconductors 3Y, 3M, 3C, and 3K. The difference in voltage value is shown in FIG. 5 as a difference D21. In the present embodiment, the difference in voltage value corresponds to a difference between the first electrical state and the second electrical state. CPU 310 further obtains the number of print copies from the time of start of use of the first photoconductor until the time of start of use of the second photoconductor.

CPU 310 specifies by using difference D21, how many photoconductors were attached before the initial voltage value exceeds a threshold value for a lifetime. CPU 310 assumes that the initial voltage value increases in increments of difference D21 each time a photoconductor is replaced. In the example in FIG. 5, CPU 310 predicts that the initial voltage value exceeds the threshold value for the lifetime when a fifth photoconductor is attached.

In the example in FIG. 5, CPU 310 outputs the lifetime of primary transfer rollers 7Y, 7M, 7C, and 7K as the number of print copies. More specifically, CPU 310 outputs as the lifetime, a predicted value of the number of print copies corresponding to the number of photoconductors specified as above and a predicted value of the number of print copies corresponding to the number of photoconductors smaller by one than the former.

In the example in FIG. 5, the number of print copies from the time of start of use of the first photoconductor until the time of start of use of the second photoconductor is 300 k (300,000 copies; "k" representing 1000; to be understood similarly hereinafter). The initial voltage value exceeds the threshold value for the lifetime at the time of start of use of the fifth photoconductor. It is expected that end of the life of the primary transfer roller will come between the time of start of use of a fourth photoconductor and the time of start of use of the fifth photoconductor (between third replacement of the photoconductor and fourth replacement of the photoconductor). Thus, CPU 310 outputs 900 k copies to 1200 k copies as the lifetime of the primary transfer (Flow of Processing)

Figure 6:
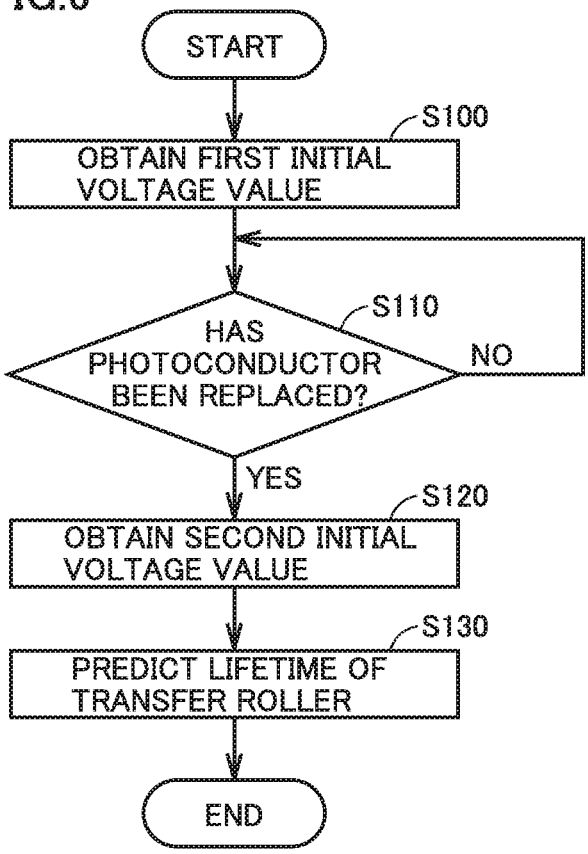
FIG. 6 is a flowchart of processing performed for prediction of a lifetime of the primary transfer roller.

FIG. 6 is a flowchart of processing performed by CPU 310 for prediction of a lifetime of the primary transfer roller.

Referring to FIG. 6, CPU 310 obtains a first initial voltage value in step S100. In step S100, CPU 310 obtains the number of print copies corresponding to the first initial voltage value.

CPU 310 then determines in step S110 whether or not a photoconductor has been replaced. For example, when CPU 310 detects attachment of a new photoconductor in image forming apparatus 200, it determines that the photoconductor has been replaced. The process remains in step S110 until CPU 310 detects attachment of a new photoconductor. When CPU 310 detects attachment of a new photoconductor, the process proceeds to step S120.

CPU 310 obtains a second initial voltage value in step S120. In step S120, CPU 310 obtains the number of print copies corresponding to the second initial voltage value.

In step S130, CPU 310 predicts a lifetime of the primary transfer roller by using the first initial voltage value and the number of print copies corresponding to the voltage value as well as the second initial voltage value and the number of print copies corresponding to the voltage value. The process in FIG. 6 thereafter ends.

Figure 7:
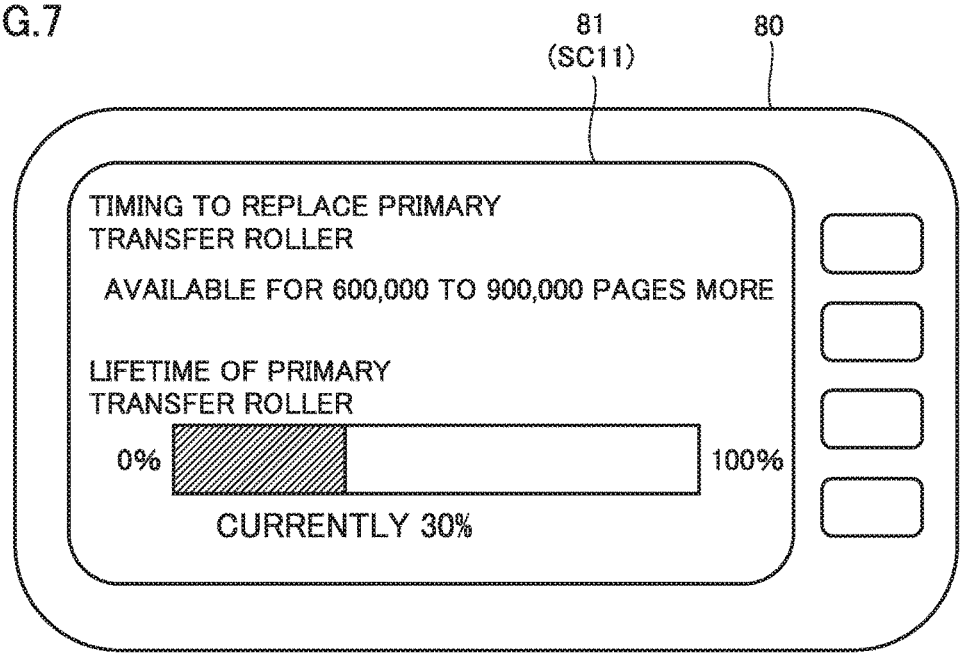
FIG. 7 is a diagram showing one example of a manner of output of a result of prediction.

In step S130, CPU 310 may output a result of prediction to operation panel 80 (FIG. 3). FIG. 7 is a diagram showing one example of a manner of output of a result of prediction.

FIG. 7 shows appearance of operation panel 80. Operation panel 80 includes a display 81. FIG. 7 shows an image SC11 on display 81.

Image SC11 shows a remaining number of print copies as a result of prediction. The result shown in the example in FIG. 7 is obtained at the time of second attachment of the photoconductor. In the example in FIG. 5, the result of prediction indicates "900 k to 1200 k copies." By the time of start of use of the second photoconductor, 300 k copies have already been printed. Therefore, the remaining number of print copies until end of the life of the primary transfer roller is "600 k to 900 k copies" which is derived by subtracting 300 k copies from the upper limit and the lower limit of the result of prediction. Thus, image SC11 includes a message "available for 600,000 to 900,000 pages more" together with a character string "timing to replace primary transfer roller."

CPU 310 may output a ratio of the current number of print copies to the number of print copies corresponding to the lifetime as a result of prediction of the lifetime. For example, a ratio of the current number of print copies (300 k) to the lower limit value (900 k) of the result of prediction is shown per 10%. In the example in FIG. 7, the ratio "30%" is shown.

CPU 310 derives a ratio W, for example, in accordance with an expression (4) as follows.

$$W=(\text{second initial voltage value}-\text{first initial voltage value})/(\text{threshold value for lifetime}-\text{first initial voltage value}) \quad (4)$$

$$=\{(800\text{ V}-500\text{ V})/(1500\text{ V}-500\text{ V}\}\times 100$$

$$=30\%$$

(Form of Output of Result of Prediction)

CPU 310 may generate and output information representing the number of times that the photoconductor can be replaced as a result of prediction of the lifetime of the primary transfer roller. A message "timing to replace primary transfer roller: before using fifth photoconductor" represents one example of a manner of output. A message "timing to replace primary transfer roller: before fourth replacement of photoconductor" represents another example. A message "timing to replace primary transfer roller: at the time of third replacement of photoconductor" represents yet another example.

Image forming apparatus 200 may include a replacement counter which counts the number of times of replacement of a photoconductor. The replacement counter updates a count value in response to detection of replacement of a photoconductor with a feature which senses replacement of a photoconductor described above. A result of prediction of the lifetime may be output in accordance with a count value of the replacement counter. For example, when end of the life of the primary transfer roller is predicted to come between third replacement of the photoconductor and fourth replacement of the photoconductor, CPU 310 may output a message "replace the primary transfer roller at the time of next replacement of the photoconductor" with third replacement of the photoconductor (attachment of the fourth photoconductor) being set as a condition. The message represents one example of the result of prediction of the lifetime.

Second Embodiment (Manner of Prediction of Lifetime of Primary Transfer Roller)

Figure 8:
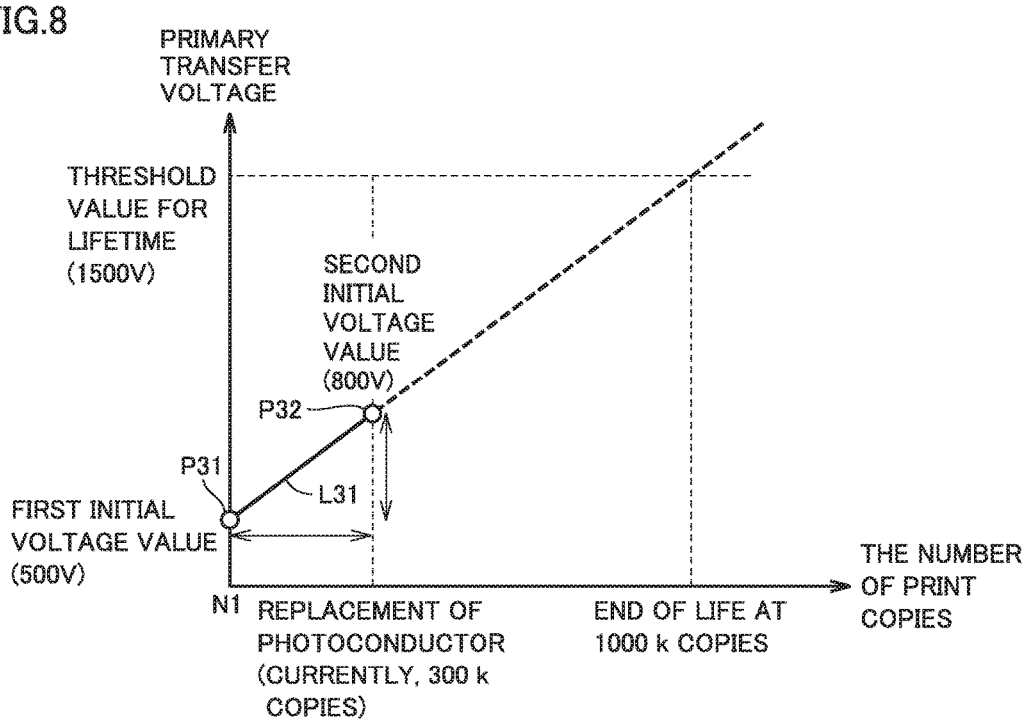
FIG. 8 is a diagram for illustrating another example of a manner of prediction of a lifetime of the primary transfer roller in the image forming apparatus.

FIG. 8 is a diagram for illustrating another example of a manner of prediction of the lifetime of the primary transfer roller in image forming apparatus 200. In the graph in FIG. 8, the ordinate represents a primary transfer voltage. The abscissa represents the number of print copies in image forming apparatus 200. A point P31 shows a plot corresponding to a first initial voltage value. A point P32 shows a plot corresponding to a second initial voltage value. Point P31 corresponds to a value for the primary transfer voltage of 500 V and the number of print copies (the first number of print copies: 0). Point P32 corresponds to a value for a primary transfer voltage of 800 V and the number of print copies (the second number of print copies: 300 k).

In the example shown in FIG. 8, CPU 310 specifies a line L31 for predicting relation between the primary transfer voltage and the number of print copies by using point P31 and point P32. A slope R of line L31 is derived, for example, in accordance with an expression (5) below.

$$R=(\text{second initial voltage value}-\text{first initial voltage value})/(\text{the second number of print copies}-\text{the first number of print copies}) \quad (5)$$

$$=(800\text{ V}-500\text{ V})/(300\text{ k}-0)$$

$$=0.001\text{ V/copies}$$

CPU 310 specifies the number of print copies corresponding to the threshold value for the lifetime in accordance with line L31. In the example in FIG. 8, 1000 k is specified as the number of print copies. CPU 310 outputs the thus specified number of print copies as the lifetime. CPU 310 predicts that end of the life of the primary transfer roller will come when the number of print copies reaches 1000 k.

An example of the manner of prediction in FIG. 8 will further be described with reference to the flowchart in FIG. 6.

CPU 310 obtains a first initial voltage value in step S100. After CPU 310 detects replacement of the photoconductor in step S110, it obtains a second initial voltage value in step S120. CPU 310 predicts the lifetime of the primary transfer roller by specifying the number of print copies corresponding to the threshold value for the lifetime, for example, by using line L31 in step S130. CPU 310 does not have to specify line L31 when proportional relation specified by point P31 and point P32 is used.

Figure 9:
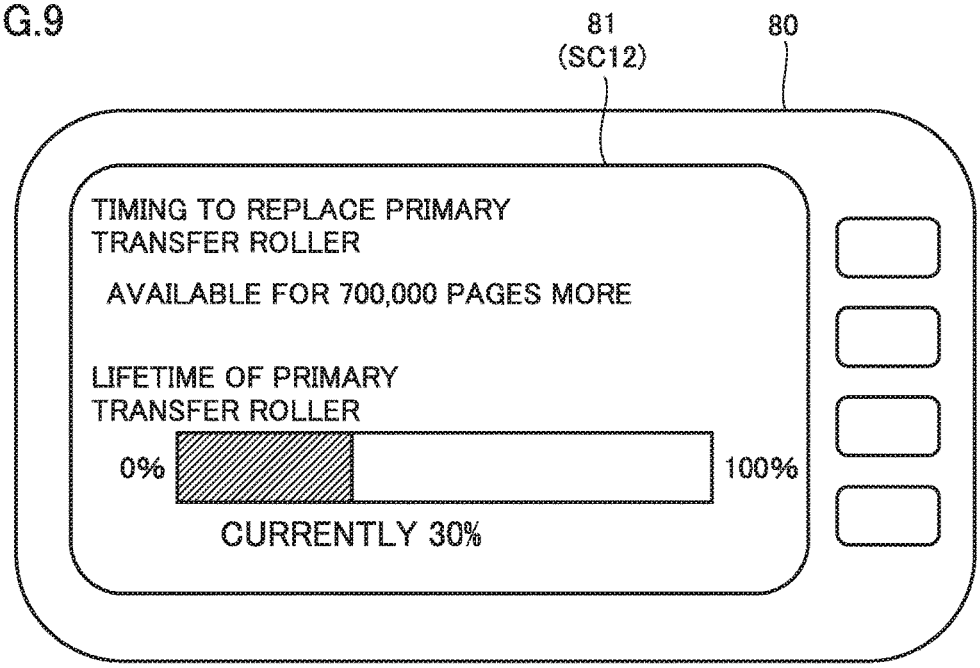
FIG. 9 is a diagram for illustrating one example of a manner of output of a result of prediction in accordance with the manner of prediction in FIG. 8.

FIG. 9 is a diagram for illustrating one example of a manner of output of a result of prediction in accordance with the manner of prediction in FIG. 8. A screen SC12 in FIG. 9 includes a message "available for 700,000 pages more." Seven hundred thousand pages (700 k) (the remaining number of print copies L) can be derived, for example, in accordance with an expression (6) as follows.

$$L=(\text{threshold value for lifetime}-\text{second initial voltage value})/R \quad (6)$$

$$=(1500\text{ V}-800\text{ V})/(0.001\text{ V/copies})$$

$$=700{,}000$$

Third Embodiment (Manner of Prediction of Lifetime of Primary Transfer Roller)

Figure 10:
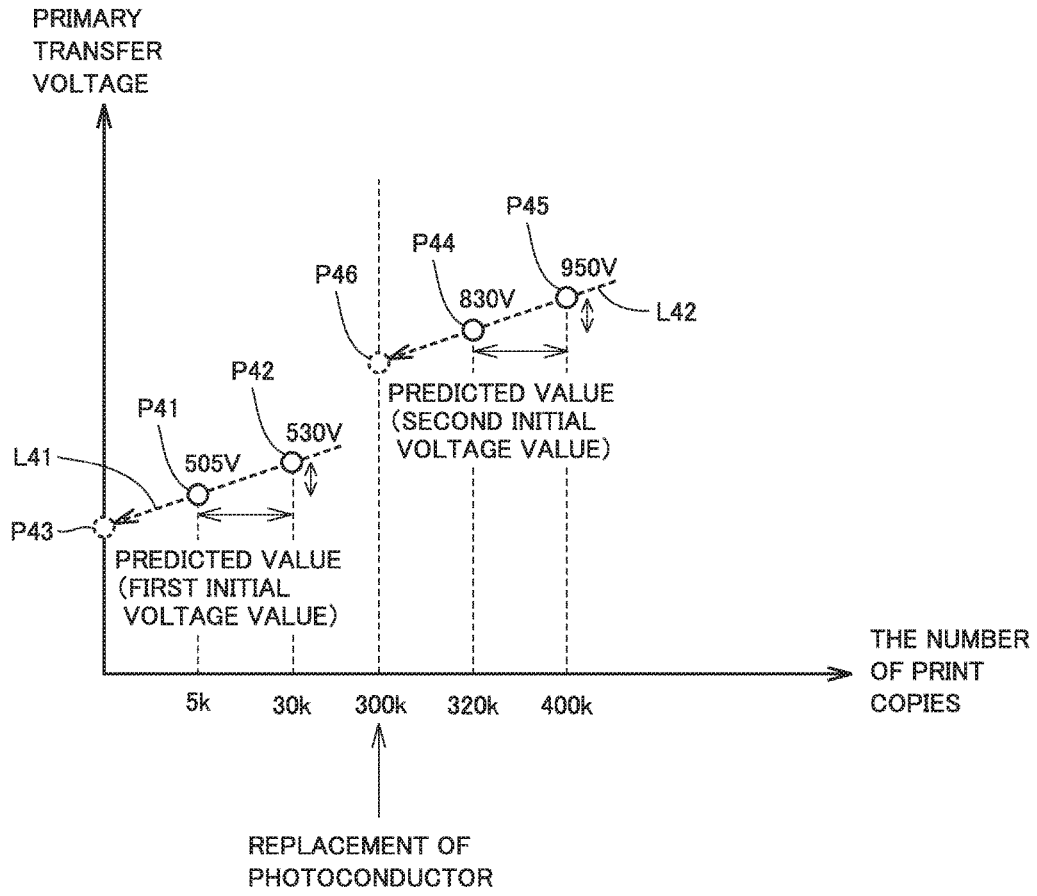
FIG. 10 is a diagram for illustrating another example of a manner of prediction of a lifetime of the primary transfer roller in the image forming apparatus.

FIG. 10 is a diagram for illustrating yet another example of a manner of prediction of a lifetime of the primary transfer roller in image forming apparatus 200. In the graph in FIG. 10, the ordinate represents a primary transfer voltage. The abscissa represents the number of print copies in the image forming apparatus.

In the graph in FIG. 10, a point P43 shows a first initial voltage value. A point P46 shows a second initial voltage value.

In the example in FIG. 10, CPU 310 predicts point P43 from a point P41 and a point P42. More specifically, CPU 310 obtains actually measured values at point P41 and point P42 at given timing after a first photoconductor is attached. CPU 310 derives a linear approximation line (a line L41) in accordance with linear regression analysis with point P41 and point P42, CPU 310 specifies point P43 corresponding to the number of print copies (0) at the time of start of use of the first photoconductor on line L41 and obtains a value for the primary transfer voltage to which point P43 corresponds as a predicted value of the first initial voltage value.

CPU 310 predicts point P46 from a point P44 and a point P45. More specifically, CPU 310 obtains actually measured values at point P44 and point P45 at given timing after a second photoconductor is attached. CPU 310 derives a linear approximation line (a line L42) in accordance with linear regression analysis with point P44 and point P45. CPU 310 specifies point P46 corresponding to the number of print copies (300 k) at the time of start of use of the second photoconductor on line L42 and obtains a value for the primary transfer voltage to which point P46 corresponds as a predicted value of the second initial voltage value.

As above, in the example in FIG. 10, CPU 310 obtains (predicted values of) the first initial voltage value and the second initial voltage value by using the primary transfer voltage (and the number of print copies) obtained at timing other than the time of start of use of a new photoconductor. Timing when image stabilization processing is performed in image forming apparatus 200 represents one example of timing other than the time of start of use of a new photoconductor. Power on of image forming apparatus 200 represents another example.

CPU 310 may obtain any one of the first initial voltage value and the second initial voltage value as an actually measured value and may obtain the other as a predicted value.

(Description Using Specific Numeric Value)

The example in FIG. 10 will be described below with reference to specific examples of numeric values.

Firstly, prediction of a first initial voltage value will be described.

Point P41 shows a value for the primary transfer voltage (505 V) and the number of print copies (5 k).

Point P42 shows a value for the primary transfer voltage (530 V) and the number of print copies (30 k).

Slope R (L41) of line L41 is derived as 0.001 V/copies in accordance with an expression (7) as follows.

$$R(L41)=(530\text{ V}-505\text{ V})/(30{,}000-5{,}000) \quad (7)$$

$$=0.001\text{ V/copies}$$

The first initial voltage value is derived as 500 V, as an intercept A1 of line L41, in accordance with an expression (8) or (9) as follows.

$$A1=(\text{voltage value at point } P41)-\{(R(L41)\times(\text{the number of print copies at point } P41)\} \quad (8)$$

$$=505\text{ V}-0.001\text{ V/copies}\times5000$$

$$=500\text{ V}$$

$$A1=(\text{voltage value at point } P42)-\{(R(L41)\times(\text{the number of print copies at point } P42)\} \quad (9)$$

$$=530\text{ V}-0.001\text{ V/copies}\times30000$$

$$=500\text{ V}$$

Next, prediction of a second initial voltage value will be described.

Point P44 shows a value for the primary transfer voltage (830 V) and the number of print copies (320 k).

Point P45 shows a value for the primary transfer voltage (950 V) and the number of print copies (400 k).

Slope R (L42) of line L42 is derived as 0.0015 V/copies in accordance with an expression (10) as follows.

$$R(L42)=(950\text{ V}-830\text{ V})/(400{,}000-320{,}000) \quad (10)$$

$$=0.0015\text{ V/copies}$$

A second initial voltage value A2 is derived as 800 V in accordance with an expression (11) or (12) as follows. The second initial voltage value is a value for the primary transfer voltage at the time of attachment of the second photoconductor (the number of print copies 300 k) on line L42.

$$A2=(\text{voltage value at point } P44)-\{(R(L42)\times(\text{the number of print copies at point } P44-300\text{ k})\} \quad (11)$$

$$=830\text{ V}-0.0015\text{ V/copies}\times20{,}000$$

$$=800\text{ V}$$

$$A2=(\text{voltage value at point } P45)-\{(R(L42)\times(\text{the number of print copies at point } P45-300\text{ k})\} \quad (12)$$

$$=950\text{ V}-0.0015\text{ V/copies}\times100{,}000$$

$$=800\text{ V}$$

(Manner of Prediction of Initial Voltage Value)

Figure 11:
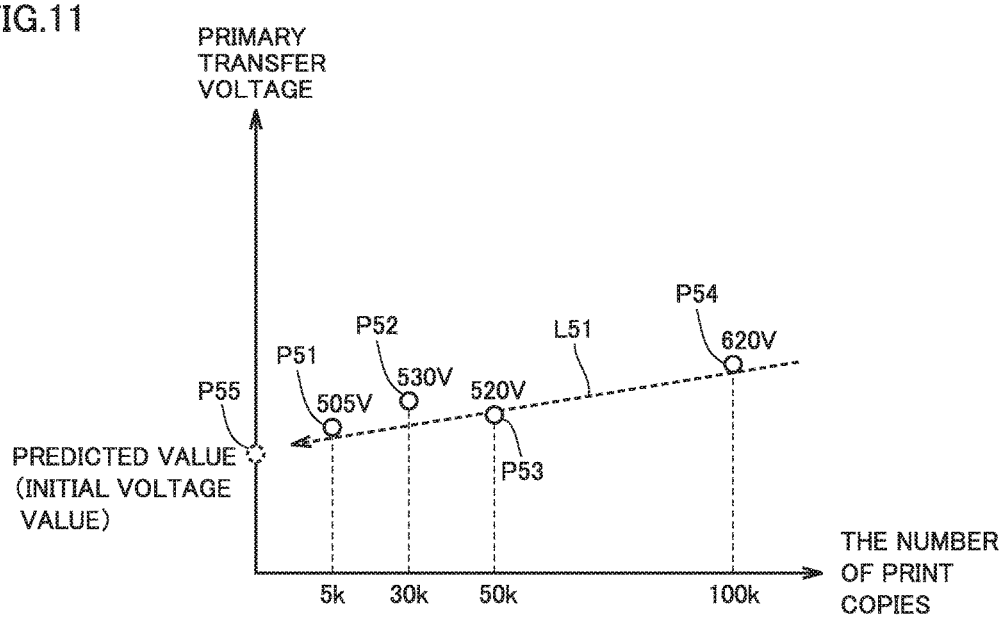
FIG. 11 is a diagram for illustrating another example of a manner of prediction of an initial voltage value.

CPU 310 may predict an initial voltage value based on linear regression analysis of three or more plots. FIG. 11 is a diagram for illustrating another example of a manner of prediction of an initial voltage value. In the graph in FIG. 11, the ordinate represents a primary transfer voltage. The abscissa represents the number of print copies in the image forming apparatus.

In the graph in FIG. 11, a point P55 shows a predicted value of an initial voltage value. In the example in FIG. 11, CPU 310 obtains actually measured values at four points (a point P51, a point P52, a point P53, and a point P54). Thereafter, CPU 310 derives a linear approximation line (a line L51) in accordance with linear regression analysis based on the actually measured values at the four points. CPU 310 obtains a value for the primary transfer voltage corresponding to the number of print copies at the time of replacement of a photoconductor on the linear approximation line as a predicted value of the initial voltage value.

CPU 310 can predict not only a first initial voltage value but also second and subsequent initial voltage values in the manner in accordance with FIG. 11.

Fourth Embodiment (Correction of Predicted Lifetime of Primary Transfer Roller)

Figure 12:
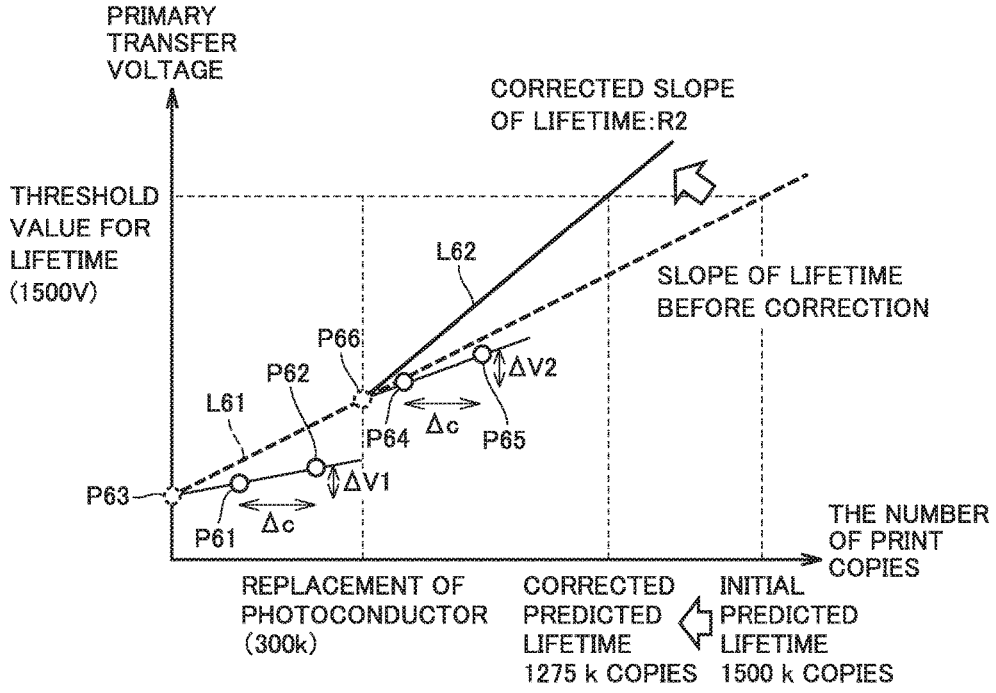
FIG. 12 is a diagram for illustrating one example of a manner of correction of a lifetime of the primary transfer roller.

Image forming apparatus 200 may correct a lifetime of the primary transfer roller which has once been predicted, depending on a condition of use. FIG. 12 is a diagram for illustrating one example of a manner of correction of a lifetime of the primary transfer roller. In the graph in FIG. 12, the ordinate represents a primary transfer voltage. The abscissa represents the number of print copies in the image forming apparatus.

In FIG. 12, a point P63 shows a first initial voltage value. A point P66 shows a second initial voltage value. A line L61 is a straight line found from point P63 and point P66. CPU 310 initially predicts a lifetime of the primary transfer roller in accordance with line L61. In the example in FIG. 12, a lifetime of the primary transfer roller is specified as the time when the number of print copies reaches 1500 k.

In the example in FIG. 12, CPU 310 obtains a plurality of actual measurement points (a point P61 and a point P62 in FIG. 12) during use of the first photoconductor. CPU 310 obtains a plurality of actual measurement points (a point P64 and a point P65 in FIG. 12) during use of the second photoconductor. A plurality of actually measured values obtained during use of the second photoconductor are obtained at an interval of the number of print copies the same as that for the plurality of actually measured values obtained during use of the first photoconductor. When a difference in number of print copies between point P61 and point P62 is, for example, 10 k, a difference in number of print copies between point P64 and point P65 is also 10 k. Such a difference in number of print copies in FIG. 12 is denoted as a difference Δc.

CPU 310 obtains a difference (variation) in value for the primary transfer voltage between point P61 and point P62 as a difference ΔV1. CPU 310 obtains a difference (variation) in value for the primary transfer voltage between point P64 and point P65 as a difference ΔV2. CPU 310 corrects a lifetime L(1) found from the first initial voltage value and the second initial voltage value in accordance with an expression (13) as follows. The expression (13) represents a corrected lifetime as a lifetime L(2).

$$\text{Lifetime } L(2)=\text{lifetime } L(1)\times(\Delta V1/\Delta V2) \quad (13)$$

For example, when the number of print copies corresponding to an initial lifetime is predicted as 1500 k, ΔV1 is set to 120 V, and ΔV2 is set to 140 V, the number of print copies corresponding to the lifetime is corrected to 1275 k in accordance with expressions (14) and (15) as follows.

$$\Delta V1/\Delta V2=120\text{ V}/140\text{ V} \quad (14)$$

$$\approx0.85$$

$$\text{The corrected number of print copies}=1500\text{ k}\times(120\text{ V}/140\text{ V}) \quad (15)$$

$$\approx1275\text{ k}$$

When deterioration of the primary transfer roller is more severe during use of the second photoconductor than during use of the first photoconductor, it is predicted that ΔV2 is greater than ΔV1. In this case, lifetime L(2) is corrected to be shorter than lifetime L(1).

(Flow of Processing)

Figure 13:
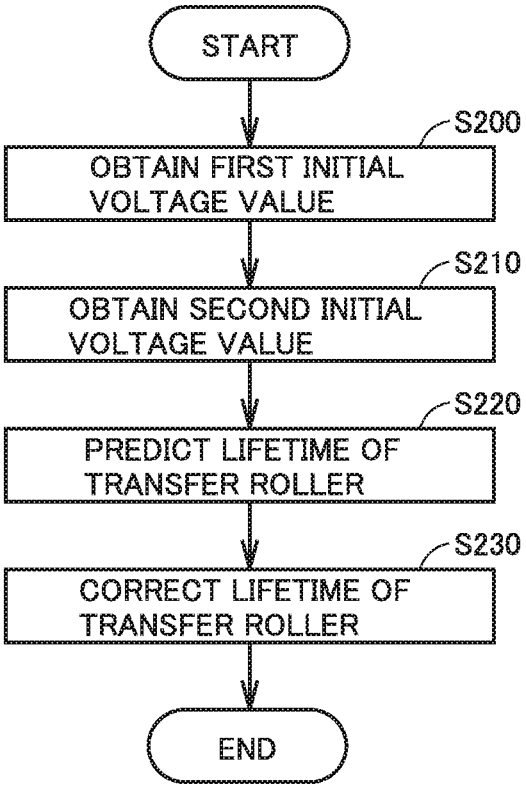
FIG. 13 is a flowchart of one example of processing performed for predicting a lifetime of the primary transfer roller in accordance with the example in FIG. 12.

FIG. 13 is a flowchart of one example of processing performed for predicting a lifetime of the primary transfer roller in accordance with the example in FIG. 12.

Referring to FIG. 13, CPU 310 obtains a first initial voltage value in step S200. The first initial voltage value may be obtained as an actually measured value obtained at the time of attachment of a first photoconductor or predicted from a plurality of plots after attachment.

CPU 310 obtains a second initial voltage value in step S210. The second initial voltage value may be obtained as an actually measured value obtained at the time of attachment of the second photoconductor or predicted from a plurality of plots after attachment.

CPU 310 predicts a lifetime of the primary transfer roller from the first initial voltage value and the second initial voltage value in step S220.

As described with reference to FIG. 12, in step S230, CPU 310 corrects prediction of the lifetime of the primary transfer roller obtained in step S220.

Fifth Embodiment (Manner of Prediction of Lifetime of Primary Transfer Roller)

In correction of prediction described with reference to FIG. 12, CPU 310 obtains a plurality of actually measured values (point P61 and point P62 in FIG. 12) during use of the first photoconductor and a plurality of actually measured values (point P64 and point P65 in FIG. 12) during use of the second photoconductor at an equal interval of the number of print copies (difference Δc in FIG. 12). Such an interval of the number of print copies may be different for each of the first and second photoconductors.

Figure 14:
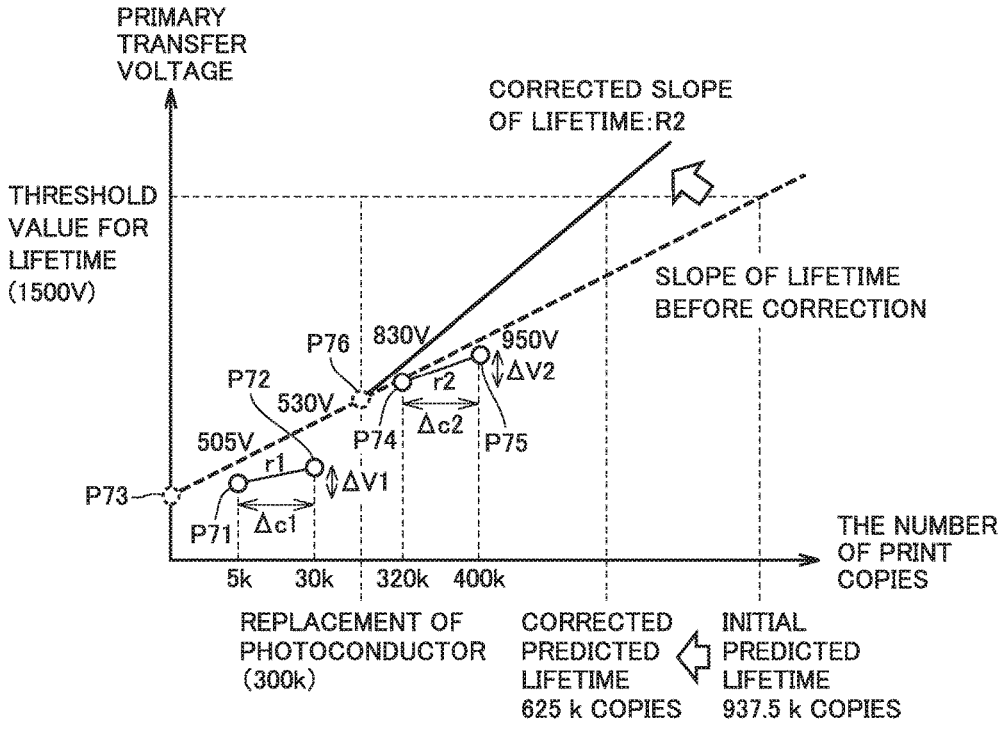
FIG. 14 is a diagram for illustrating another example of a manner of correction of a lifetime of the primary transfer roller.

FIG. 14 is a diagram for illustrating another example of a manner of correction of a lifetime of the primary transfer roller. In the graph in FIG. 14, the ordinate represents a primary transfer voltage. The abscissa represents the number of print copies in the image forming apparatus. In FIG. 14, a point P73 shows a first initial voltage value. A point P76 shows a second initial voltage value.

As shown in FIG. 14, CPU 310 obtains a plurality of actually measured values (a point P71 and a point P72) during use of the first photoconductor. A difference in value for the primary transfer voltage between point P71 and point P72 is shown as difference ΔV1 and a difference in number of print copies therebetween is shown as a difference Δc1.

CPU 310 obtains a plurality of actually measured values (a point P74 and a point P75) during use of the second photoconductor. A difference in value for the primary transfer voltage between point P74 and point P75 is shown as difference ΔV2 and a difference in number of print copies therebetween is shown as a difference Δc2.

In the example in FIG. 14, CPU 310 derives a coefficient r1 for the first photoconductor in accordance with an expression (16) as follows.

$$r1=\Delta V1/\Delta c1 \quad (16)$$

CPU 310 derives a coefficient r2 for the second photoconductor in accordance with an expression (17) as follows.

$$r2=\Delta V2/\Delta c2 \quad (17)$$

CPU 310 corrects prediction of a lifetime of the primary transfer roller by using coefficient r1 and coefficient r2. CPU 310 corrects the number of print copies corresponding to the lifetime, for example, in accordance with an expression (18) as follows, instead of the expression (15).

$$\text{The corrected number of print copies}=\text{the number of print copies before correction}\times(r/r2) \quad (18)$$

In the example in FIG. 14, ΔV1 is calculated as 25 V (530 V−505 V). Δc1 is calculated as 25000 (30000−5000). Thus, r1 is calculated as 0.001 (25/25000).

ΔV2 is calculated as 120 V (950 V−830 V). Δc2 is calculated as 80000 (400000−320000). Thus, r2 is calculated as 0.0015 (120/80000).

From the foregoing, when the number of print copies corresponding to a lifetime before correction is assumed as 937.5 k, the corrected number of print copies is specified as 625 k from an expression (19) as follows.

$$\text{The corrected number of print copies}=937.5\text{ k}\times(0.001/0.0015) \quad (19)$$

$$=625\text{ k}$$

Sixth Embodiment (Schematic Configuration)

Electrical characteristics of a primary transfer roller may be affected by a temperature and a humidity while the primary transfer roller is operated (a voltage is applied). An image forming apparatus according to one embodiment predicts a lifetime of the primary transfer roller in consideration of a temperature and a humidity.

Figure 15:
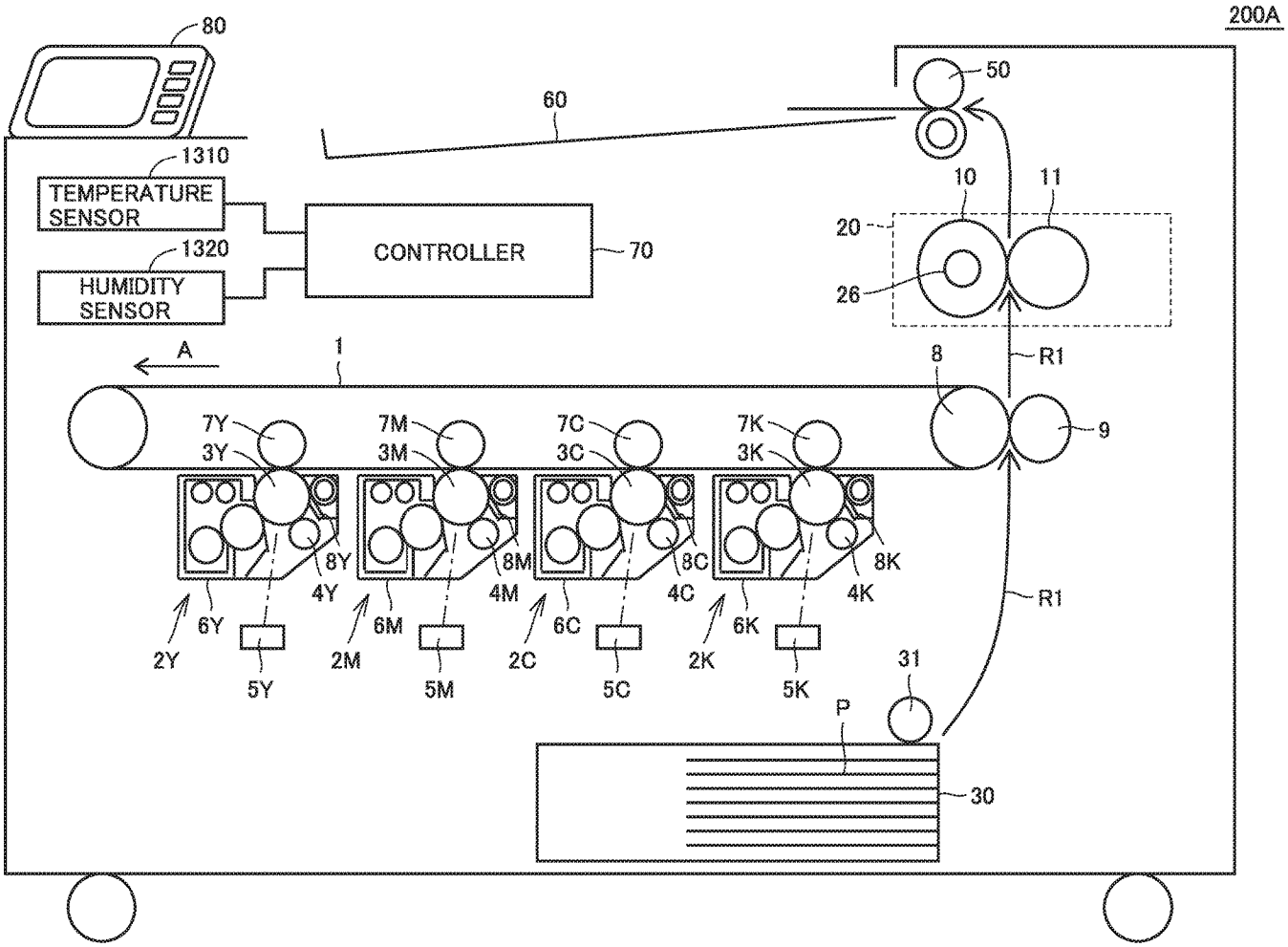
FIG. 15 is a diagram illustrating a configuration of an image forming apparatus according to one embodiment.

FIG. 15 is a diagram illustrating a configuration of an image forming apparatus 200A according to one embodiment. Description with reference to FIG. 2 is incorporated by reference for a portion identical in reference character to FIG. 2.

As shown in FIG. 15, image forming apparatus 200A is different from image forming apparatus 200 shown in FIG. 2 in including a temperature sensor 1310 and a humidity sensor 1320. Controller 70 is electrically connected to each of temperature sensor 1310 and humidity sensor 1320.

(Correction Value Associated with Value Relating to Environment)

Figure 16:
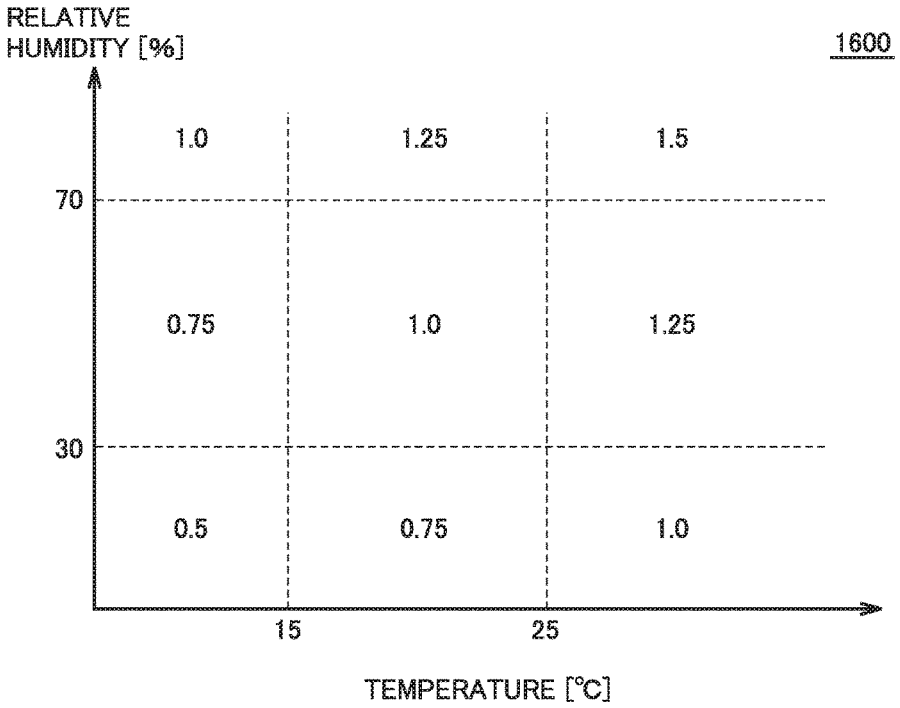
FIG. 16 is a diagram illustrating a temperature and humidity table according to one embodiment.

FIG. 16 is a diagram illustrating a temperature and humidity table 1600 according to one embodiment. Temperature and humidity table 1600 may be stored, for example, in data storage portion 374 of storage device 370. In temperature and humidity table 1600, the ordinate represents a relative humidity (%) and the abscissa represents a temperature (° C.). Though temperature and humidity table 1600 in FIG. 16 is shown as a two-dimensional table for the sake of ease of description, a coefficient is held actually in association with a temperature range and a humidity range.

In temperature and humidity table 1600, a value for a coefficient is greater as a temperature is higher. A value for the coefficient is greater as a humidity is higher. A value for the coefficient is smaller as a temperature is lower. A value for the coefficient is smaller as a humidity is lower.

CPU 310 corrects a predicted value of a lifetime by using a coefficient specified by measurement values of the temperature and the humidity. CPU 310 derives the number of print copies corresponding to the corrected lifetime, for example, by finding a product of a value for the number of print copies corresponding to the lifetime before correction and the coefficient.

The greater derived number of print copies means a longer time before the end of the life of the primary transfer roller. Therefore, the lifetime is longer as the temperature is higher. The lifetime is longer as the humidity is higher. The lifetime is shorter as the temperature is lower. The lifetime is shorter as the humidity is lower. The lifetime of the primary transfer roller is longer as the temperature and the humidity are higher. The lifetime of the primary transfer roller is shorter as the temperature and the humidity are lower.

(Flow of Processing)

Figure 17:
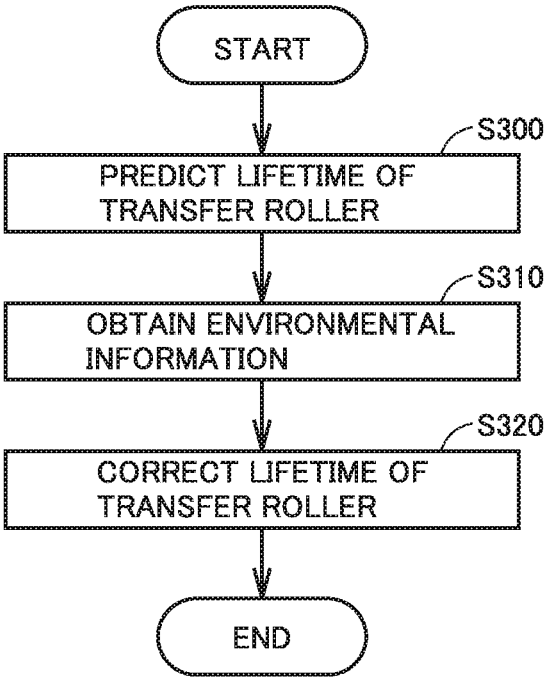
FIG. 17 is a flowchart of processing performed for predicting a lifetime in accordance with the example in FIGS. 15 and 16.

FIG. 17 is a flowchart of processing performed for predicting a lifetime in accordance with the example in FIGS. 15 and 16.

Referring to FIG. 17, in step S300, CPU 310 predicts a lifetime of the primary transfer roller by using the first initial voltage value and the second initial voltage value as described above.

CPU 310 obtains environmental information in step S310. Temperature data obtained by temperature sensor 1310 and humidity data obtained by humidity sensor 1320 represent one example of the environmental information.

In step S320, CPU 310 specifies a coefficient (FIG. 16) by using the temperature data and the humidity data obtained in step S310, and corrects prediction of the lifetime obtained in step S300 by using the coefficient.

Image forming apparatus 200A may externally obtain temperature data and/or humidity data. In this case, image forming apparatus 200A does not have to include temperature sensor 1310 and/or humidity sensor 1320.

Image forming apparatus 200A may correct a lifetime of the primary transfer roller by using only any one of temperature data and humidity data. In this case, a table for specifying a coefficient based on only any one of a temperature and a humidity may be used instead of temperature and humidity table 1600.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an image carrier set as being replaceable;

a transfer member arranged as being opposed to the image carrier with a transfer target being interposed and configured to transfer a toner image formed on the image carrier to the transfer target;

a measurement instrument configured to measure at least one of a voltage value and a current value of the transfer member as an electrical state of the transfer member while the transfer member is brought in pressure contact with the image carrier with the transfer target being interposed; and a controller configured to predict a lifetime of the transfer member based on a first electrical state and a second electrical state, the first electrical state being an electrical state of the transfer member when a first image carrier is attached as the image carrier, and the second electrical state being an electrical state of the transfer member when a second image carrier different from the first image carrier is attached as the image carrier after formation of an image by using the first image carrier.

2. The image forming apparatus according to claim 1, wherein the controller is configured to predict the lifetime of the transfer member based on a difference between the first electrical state and the second electrical state.

3. The image forming apparatus according to claim 2, wherein the controller is configured to generate information representing the number of times that the image carrier can be replaced which corresponds to the lifetime of the transfer member based on the difference between the first electrical state and the second electrical state.

4. The image forming apparatus according to claim 1, wherein the controller is configured to predict the lifetime of the transfer member based on linear regression analysis by using the first electrical state and a first amount of recording media representing an amount of recording media to which the toner image has been transferred, the first amount of recording media corresponding to the first electrical state, and the second electrical state and a second amount of recording media representing an amount of recording media to which the toner image has been transferred, the second amount of recording media corresponding to the second electrical state.

5. The image forming apparatus according to claim 1, the image forming apparatus further comprising a replacement counter which counts the number of times of replacement of the image carrier, wherein the controller is configured to obtain the first electrical state when a count value of the replacement counter is updated and to obtain the second electrical state when the count value of the replacement counter is updated.

6. The image forming apparatus according to claim 5, the image forming apparatus further comprising a detector which detects replacement of the image carrier, wherein the replacement counter updates the count value in response to detection by the detector of replacement of the image carrier.

7. The image forming apparatus according to claim 1, wherein the controller is configured to perform at least one of (i) an operation to obtain the first electrical state based on linear regression analysis by using a plurality of electrical states of the transfer member while the first image carrier is attached as the image carrier and amounts of recording media to which the toner image has been transferred, the amounts of recording media corresponding to the respective electrical states, and (ii) an operation to obtain the second electrical state based on linear regression analysis by using a plurality of electrical states of the transfer member while the second image carrier is attached as the image carrier and amounts of recording media to which the toner image has been transferred, the amounts of recording media corresponding to the respective electrical states.

8. The image forming apparatus according to claim 1, wherein the controller is configured to correct the predicted lifetime of the transfer member by using the electrical state of the transfer member when the first image carrier is attached and the electrical state of the transfer member when the second image carrier is attached.

9. The image forming apparatus according to claim 8, wherein in correction of the lifetime of the transfer member, the controller is configured to use variation in electrical state during transfer of the toner image to a predetermined amount of recording media while the first image carrier is attached as the electrical state of the transfer member when the first image carrier is attached, and use variation in electrical state during transfer of the toner image to the predetermined amount of recording media while the second image carrier is attached as the electrical state of the transfer member when the second image carrier is attached.

10. The image forming apparatus according to claim 8, wherein in correction of the lifetime of the transfer member, the controller is configured to use first variation in electrical state during transfer of the toner image to a first amount of recording media while the first image carrier is attached as the electrical state of the transfer member when the first image carrier is attached, use second variation in electrical state during transfer of the toner image to a second amount of recording media while the second image carrier is attached as the electrical state of the transfer member when the second image carrier is attached, and correct the predicted lifetime based on linear regression analysis of relation between an amount of recording media to which the toner image has been transferred and the electrical state of the transfer member by using the first variation and the second variation.

11. The image forming apparatus according to claim 1, wherein the controller is configured to correct the lifetime based on environmental information on an environment where the image forming apparatus is set.

12. The image forming apparatus according to claim 11, wherein the environmental information includes data on a temperature and a humidity, and the controller is configured to predict the lifetime as being shorter as the environment represented by the environmental information is lower in temperature and humidity and to predict the lifetime as being longer as the environment represented by the environmental information is higher in temperature and humidity.

13. A method of predicting a lifetime of a transfer member, the method being implemented by a computer of an image forming apparatus, the image forming apparatus including an image carrier set as being replaceable and the transfer member, the transfer member being arranged as being opposed to the image carrier with a transfer target being interposed and transferring a toner image formed on the image carrier to the transfer target, the method comprising:

obtaining a first electrical state including at least one of a voltage value and a current value of the transfer member when a first image carrier is attached as the image carrier;

obtaining a second electrical state including at least one of a voltage value and a current value of the transfer member when a second image carrier different from the first image carrier is attached as the image carrier after an image is formed a prescribed number of times with the first image carrier being attached; and predicting a lifetime of the transfer member based on the first electrical state and the second electrical state.

14. The method of predicting a lifetime according to claim 13, the method further comprising correcting the predicted lifetime of the transfer member with the first electrical state and the second electrical state.

* * * * *